US005964453A

United States Patent [19]

McCraw

[11] Patent Number: 5,964,453

[45] Date of Patent: Oct. 12, 1999

[54] WIRE GRID AND WIRE SPRING MODULE FOR USE WITH A FURNITURE SPRING ASSEMBLY

[75] Inventor: Kevin McCraw, Micaville, N.C.

[73] Assignee: Hickory Springs Manufacturing Co., Hickory, N.C.

[21] Appl. No.: 09/036,569

[22] Filed: Mar. 9, 1998

[51] Int. Cl.[6] ..... F16F 3/00

[52] U.S. Cl. ..... 267/103; 267/144; 5/268; 5/255

[58] Field of Search ..... 267/80, 95, 103, 267/165, 144; 5/268, 255, 247, 267

[56] References Cited

U.S. PATENT DOCUMENTS

| | | | |
|---|---|---|---|
| 4,398,705 | 8/1983 | Mizelle | 267/85 |
| 4,666,136 | 5/1987 | Hagemeister | 267/103 |
| 4,760,616 | 8/1988 | Hiatt et al. | 5/246 |
| 4,790,038 | 12/1988 | Ikeda | 5/247 |
| 4,896,386 | 1/1990 | Ogle et al. | 5/267 |
| 4,921,228 | 5/1990 | Lowe | 267/103 |
| 5,184,802 | 2/1993 | Galumbeck | 267/103 |
| 5,188,344 | 2/1993 | Dabney | 267/103 |
| 5,346,190 | 9/1994 | Dabney | 267/95 |
| 5,438,716 | 8/1995 | Dabney | 5/267 |
| 5,497,979 | 3/1996 | Schulz, Jr. et al. | 267/103 |
| 5,548,857 | 8/1996 | Richmond | 5/263 |

*Primary Examiner*—Christopher P. Schwartz
*Assistant Examiner*—Mariano Sy
*Attorney, Agent, or Firm*—Kennedy Covington Lobdell and Hickman

[57] ABSTRACT

A wire spring module and wire grid for use in a furniture spring assembly for mounting an array of multiple spring modules to the wire grid and the resulting furniture spring assembly. The wire grid includes a plurality of straight, coplanar wires arranged in a first sub-plurality of parallel spring placement wires and a second sub-plurality of parallel spring seating wires extending in generally perpendicular relation to the spring placement wires, the spring seating wires being arranged in a plurality of seating wire pairs with the spring seating wires of each seating wire pair disposed at a first predetermined spacing from one another and with each seating wire pair disposed at a second greater predetermined spacing from each seating wire pair adjacent thereto. The unitarily-formed wire spring module comprises a generally coplanar top and a pair of legs extending from opposite ends of the top and in spaced relation to one another. The top is comprised of a pair of generally J-shaped end segments arranged in spaced reverse mirror image relation to one another and connected together by an intermediate straight segment. The intersection points between each J-shaped segment and the intermediate segment form an angular relation therebetween. The wire spring module can be connected to the wire grid in two alternate positions. A furniture spring assembly comprising the disclosed wire grid with wire spring modules connected in either of the two alternate positions is also disclosed.

27 Claims, 5 Drawing Sheets

WIRE GRID AND WIRE SPRING MODULE FOR USE WITH A FURNITURE SPRING ASSEMBLY

BACKGROUND OF THE INVENTION

The present invention relates generally to furniture spring assemblies, such as mattress foundation structures or box spring assemblies, and more particularly relates to such spring assemblies and structure utilizing a wire grid for integrating multiple wire spring modules.

In spring assemblies and structures of the aforementioned type, an integrated array of plural wire spring modules, often in the form of non-coil springs, can be utilized to provide firm, yet resilient support to any cushioned or support structure in any furniture item used for seating, reclining, sleeping, or the like. Furniture spring assemblies which utilize wire coil springs mounted on a wooden base or bottom frame have been in use for many generations. Furniture spring assemblies which instead utilize non-coil springs, sometimes referred to as "wire forms," have been in use for at least thirty years. Various wire spring modules and various means for attaching such modules to a wire grid and bottom frame of a furniture spring assembly are known, as illustrated by U.S. Pat. Nos. 4,760,616, 5,188,344, 5,346,190, and 5,497,979.

SUMMARY OF THE INVENTION

It is an object of the present invention to provide an improved wire grid for use with a furniture spring assembly that allows for the quick and easy attachment of an array of multiple wire spring modules of various designs and shapes.

It is also an object of the present invention to provide a wire grid for use with a furniture spring assembly that allows wire spring modules of various designs and shapes to connect in a relatively fixed or "locked" position within the wire grid without the need for clamps or additional attachment devices.

It is a further object of the present invention to provide a wire grid for use with a furniture spring assembly with a grid arrangement that allows wire spring modules to attach to the wire grid in a variety of positions relative to the grid wires.

It is an additional object of the present invention to provide a wire spring module for use with a furniture spring assembly that is relatively easy and inexpensive to manufacture and that provides long-lasting spring-like support.

It is a further object of the present invention to provide a wire spring module for use with a furniture spring assembly that can be installed easily and effectively into the wire grid of the present invention.

To those ends, one aspect of the present invention provides a wire grid for use in a furniture spring assembly for mounting an array of multiple spring modules to the wire grid wherein, the wire grid has a generally rectangular shape and comprises a plurality of elongate wires arranged in generally perpendicular crossing relation to one another. The wires include a first sub-plurality of spring placement wires extending in generally spaced parallel relation to one another and a second sub-plurality of spring seating wires extending in generally parallel relation to one another and in generally perpendicular relation to the spring placement wires. According to the present invention, the spring seating wires are arranged in a plurality of seating wire pairs with the spring seating wires of each seating wire pair disposed at a first predetermined spacing from one another and with each seating wire pair disposed at a second predetermined spacing from each seating wire pair adjacent thereto.

It is generally preferred that the wire grid also comprise a rectangular border. Such a rectangular border may be made of wire; however, other materials could be used. Further, in the preferred embodiment, the elongate wires of the wire grid are essentially coplanar, straight tension wires. It is also preferred that the second predetermined spacing between adjacent seating wire pairs be greater than the first predetermined spacing between each spring seating wire of a seating wire pair.

According to another aspect of the present invention, a novel wire spring module is provided for use in a furniture spring assembly. The wire spring module basically comprises a generally coplanar top having a pair of generally J-shaped end segments arranged in spaced reverse mirror image relation to one another and an intermediate segment connected between respective ends of the J-shaped end segments in angular relation therewith. A pair of legs, each formed in a resilient spring configuration, are connected to respective opposite ends of the J-shaped end segments and extend therefrom in spaced relation to one another.

It is preferred that the wire spring module be unitarily formed of a single length of spring wire. In one embodiment, each of the J-shaped end segments of the wire spring module comprises a notch for engagement with the spring seating wire of a seating wire pair in a furniture spring assembly. In another embodiment, the intermediate segment of the wire spring module comprises a notch for engagement with a spring placement wire in a furniture spring assembly.

It is further preferred that each generally J-shaped end segment of the generally coplanar top of the wire spring module be comprised of a generally straight portion and a generally U-shaped portion, with one end of the generally straight portion connected to one end of the generally U-shaped portion and with the other end of the U-shaped portion connected to the intermediate segment. The other end of each straight portion is connected to a respective leg portion.

It is also preferred that the generally straight portions of each J-shaped end segment be parallel to one another. Further, in the preferred embodiment, the intersections between each generally straight portion and each generally U-shaped portion is smooth or gradual so that no angular relation is created therebetween.

In the preferred embodiment of the wire spring module, each leg comprises a planar sinuous wire spring configuration, the respective legs being located in spaced planes that are in facing, parallel relation to one another and perpendicular to the plane of the top.

Another aspect of the present invention provides a furniture spring assembly basically including a bottom frame; a wire grid disposed a predetermined distance above the bottom frame and an array of multiple spring modules extending between the wire grid and the bottom frame. The wire grid comprises a plurality of elongate wires arranged in generally perpendicular crossing relation to one another, the wires comprising a first sub-plurality of spring placement wires extending in generally spaced parallel relation to one another and a second sub-plurality of spring seating wires extending in generally parallel relation to one another and in generally perpendicular relation to the spring placement wires. The spring seating wires are arranged in a plurality of seating wire pairs with the spring seating wires of each seating wire pair disposed at a first predetermined spacing from one another and with each seating wire pair disposed at a second predetermined spacing from each seating wire pair adjacent thereto. Each wire spring module comprises a top and a pair of legs, with the top portion including first and second generally coplanar and connected attachment segments connecting the wire spring module to the wire grid, and with each of the legs being formed in a resilient spring configuration and extending in spaced relation from opposite ends of the top for connecting each end of the top with the bottom frame.

It is preferred that the bottom frame and the wire grid of the furniture spring assembly be generally rectangular in shape; however, the shapes can vary as necessary to accommodate the shape of the piece of furniture in which the furniture spring assembly will be used. It is also preferred that the second predetermined spacing between adjacent seating wire pairs be greater than the first predetermined spacing between each spring seating wire of a seating wire pair in the furniture spring assembly disclosed. Further, it is preferred that the elongate wires of the wire grid be generally coplanar, straight tension wires.

A wire spring module can connect to the wire grid in a generally rectangular module aperture defined by the spring seating wires of one seating wire pair and by spring placement wires crossing the seating wire pair. The top of the wire spring module is mounted within the rectangular module aperture so that the first attachment segment engages an outer side of one spring seating wire and an inner side of the other spring seating wire while abutting one spring placement wire and the second attachment segment engages an outer side of the other spring seating wire and an inner side of the of the one spring seating wire, while abutting the other spring placement wire. Additionally, each attachment segment can further comprise a notch to enable the first attachment segment to engage the inner side of one spring seating wire and to enable the second attachment segment to engage the inner side of the other spring seating wire.

Alternatively, when the top of each wire spring module further comprises three notches, such a wire spring module can connect to the wire grid in two adjacent generally rectangular module apertures, defined by the spring seating wires of a seating wire pair and by three successively adjacent spring placement wires. The top of the wire spring module is mounted within the two rectangular apertures so that the first attachment segment engages an outer side of one spring seating wire and a notch in the first attachment segment engages an inner side of the other spring seating wire and the second attachment segment engages an outer side of the other spring seating wire and a notch in the second attachment segment engages an inner side of the one spring seating wire, with a notch between the first and second attachment segments engaging an inner side of the intermediate one of the three spring placement wires.

DESCRIPTION OF THE PREFERRED EMBODIMENT

Figure 1:
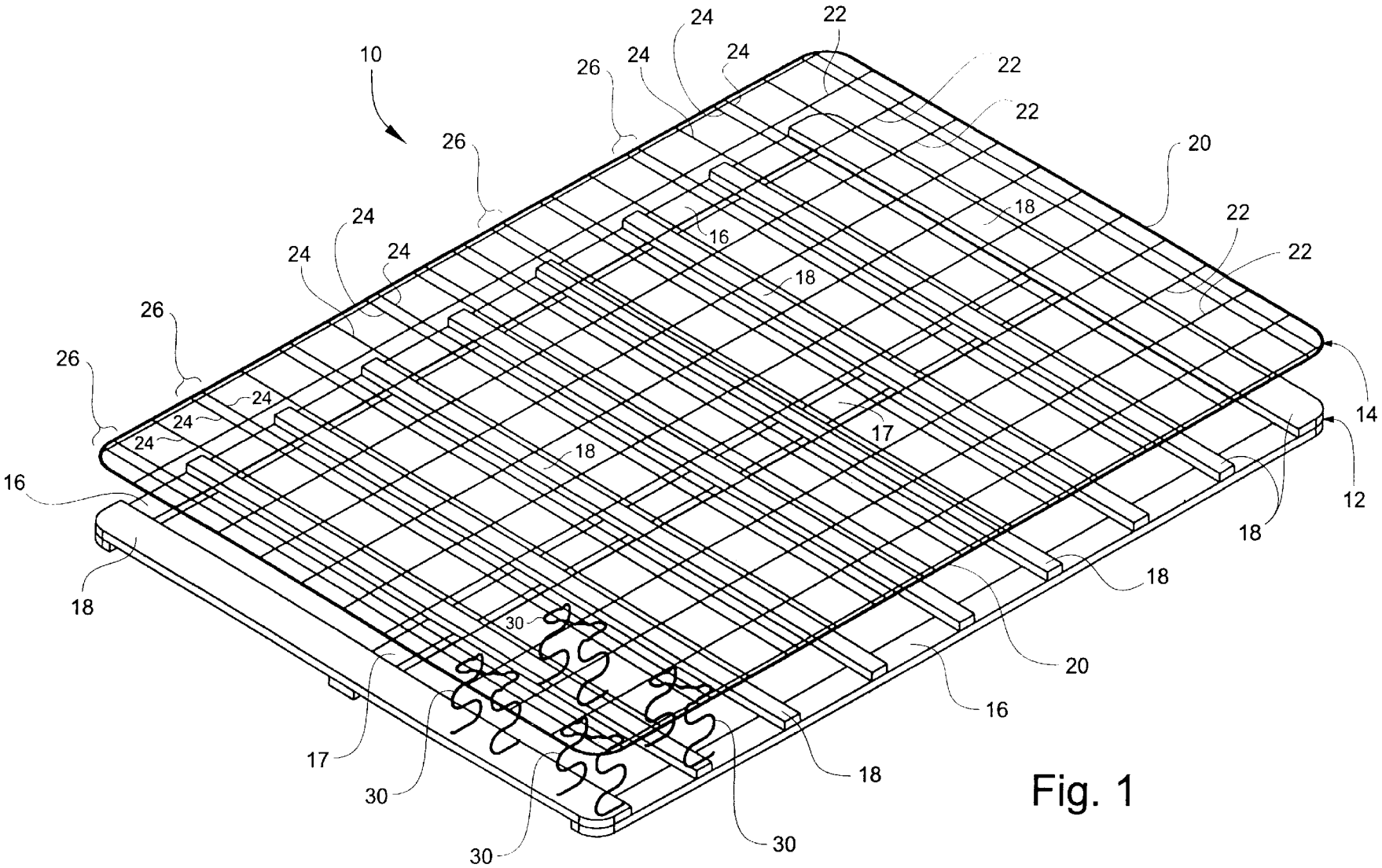
FIG. 1 is a perspective view of a furniture spring assembly according to a preferred embodiment of the present invention.
Figure 2:
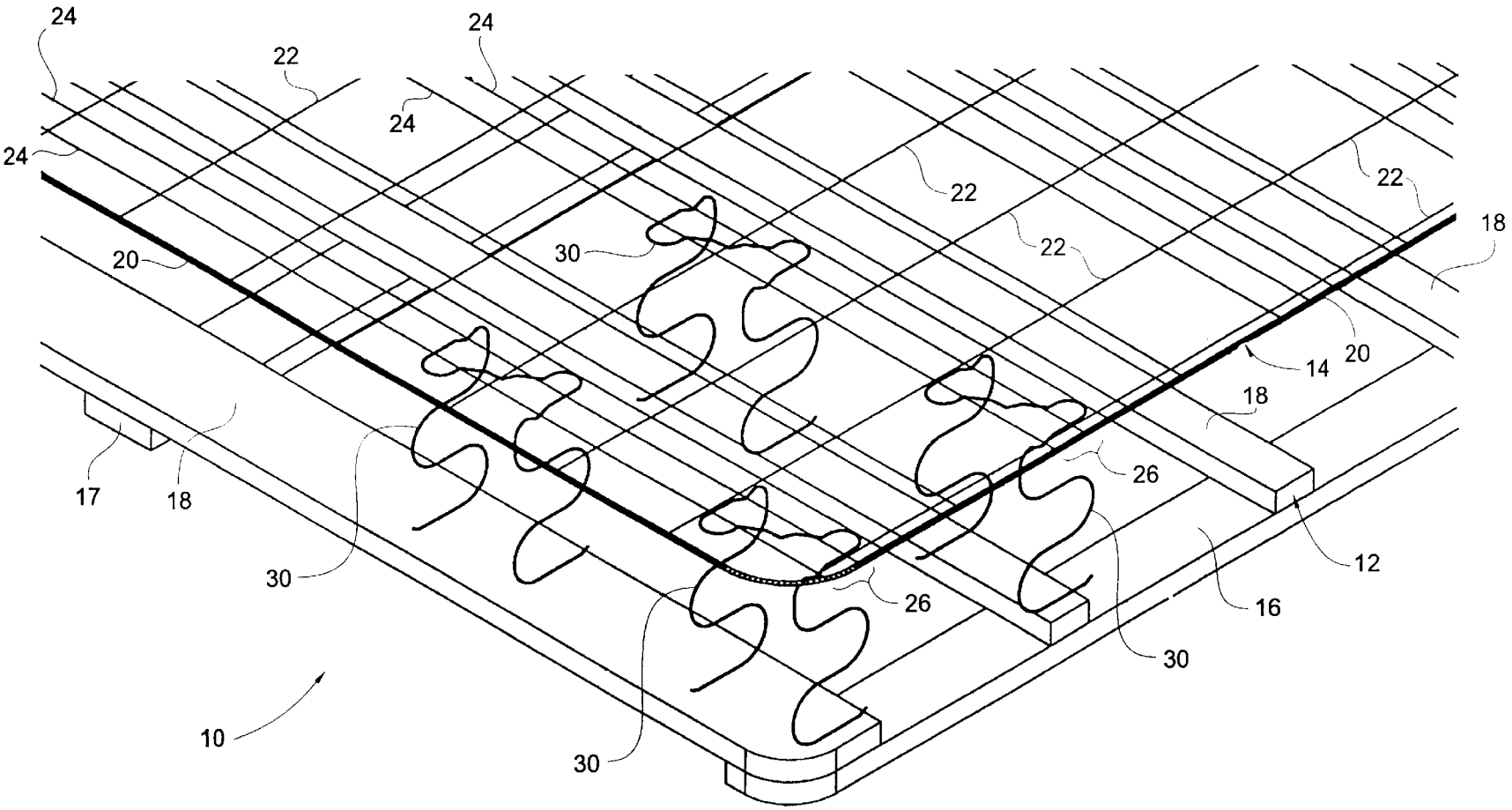
FIG. 2 is an enlarged perspective view of a portion of the furniture spring assembly of FIG. 1.

Referring now to the drawings, a furniture spring assembly, such as a mattress foundation structure or box spring assembly, in accordance with the present invention is illustrated in FIGS. 1 and 2 and generally designated at 10. The furniture spring assembly 10 basically includes a bottom frame 12, an upper wire grid 14, and an array of plural wire spring modules 30 connected therebetween. For clarity, only a few representative wire spring modules 30 are shown mounted in FIGS. 1 and 2; however, it should be generally understood that a plurality of wire spring modules 30 could be placed in numerous locations between the bottom frame 12 and the upper wire grid 14. In most contemplated embodiments of the invention, the furniture spring assembly 10 will comprise a structure intended for use as a bedding foundation, such as a box spring assembly as already indicated. However, it is also contemplated to be possible to adapt the principles of the invention to other furniture spring assemblies such as may be used in sofas, couches, upholstered chairs, and the like. Hence, as used herein, the term "furniture" as applied to the present spring assembly, and its novel wire grid and wire spring modules, is intend to have a broad meaning encompassing any article containing a spring assembly for support of a user in a supine, seated, or reclining posture.

The specific design of the bottom frame 12 may be conventional; however, a brief description follows to put the rest of the present invention into context. The bottom frame 12 is a substantially rectangular structure, disposed horizontally when in use, of a length and width that can vary depending upon the size of the piece of furniture with which the furniture spring assembly 10 will be used. As shown, this particular furniture spring assembly is ideal for use as a box spring assembly for a bed. The bottom frame 12 is most often constructed of wood (but the type of material can vary), includes at least two parallel side members 16 and may also include a middle support member 17 that is parallel to the side members 16, all of which generally define the length of the bottom frame 12. The bottom frames 12 also includes a plurality of substantially parallel cross members 18, which define the width of the bottom frame 12, with the final cross members at either end of the bottom frame 12 serving as end members. The cross and end members 18 are secured to side members 16 by staples, nails, glue, or other suitable attachment means.

The wire grid 14 is horizontally-disposed a fixed distance above the bottom frame 12 by the intervening array of spring modules 30, described below. Generally, the outer edge of the wire grid 14 is defined by border 20, which may be constructed of wire and formed into a rectangular shape with a length and width that corresponds substantially to the length and width of the bottom frame 12. Although not illustrated, it is possible to construct the wire grid 14 alternatively without a border 20. In either case, the wire grid 14 also includes a plurality of elongate wires that are arranged in a crisscrossed fashion within the interior confines of and generally coplanar with the border 20. More specifically, the plurality of elongate wires includes a sub-plurality of spring placement wires 22, which are parallel to and a fixed distance from each other. The spring placement wires 22 preferably run the length of the wire grid 14 and, if a border 20 is included, connect (by welding, wrapping, or other conventional means) to opposite ends of the border 20. The plurality of elongate wires also include a sub-plurality of spring seating wires 24, which are generally parallel to each other and generally perpendicular to the spring placement wires 22. The spring seating wires 24 preferably extend the width of the wire grid 14 and, if a border 20 is included, connect (by welding, wrapping, or other conventional means) to opposite sides of the border 20. In accordance with the present invention, the spring seating wires 24 are arranged into a plurality of seating wire pairs 26 wherein the spring seating wires 24 of each such pair 26 are disposed at a first relatively closer predetermined spacing from one another with the wire pairs 26 disposed from other pairs 26 at a second relatively greater predetermined spacing. One or more individual spring seating wires 24 may be interposed between adjacent seating wire pairs 26. Preferably, the spring placement wires 22 and the spring seating wires 24 are straight, tension wires.

Figure 3:
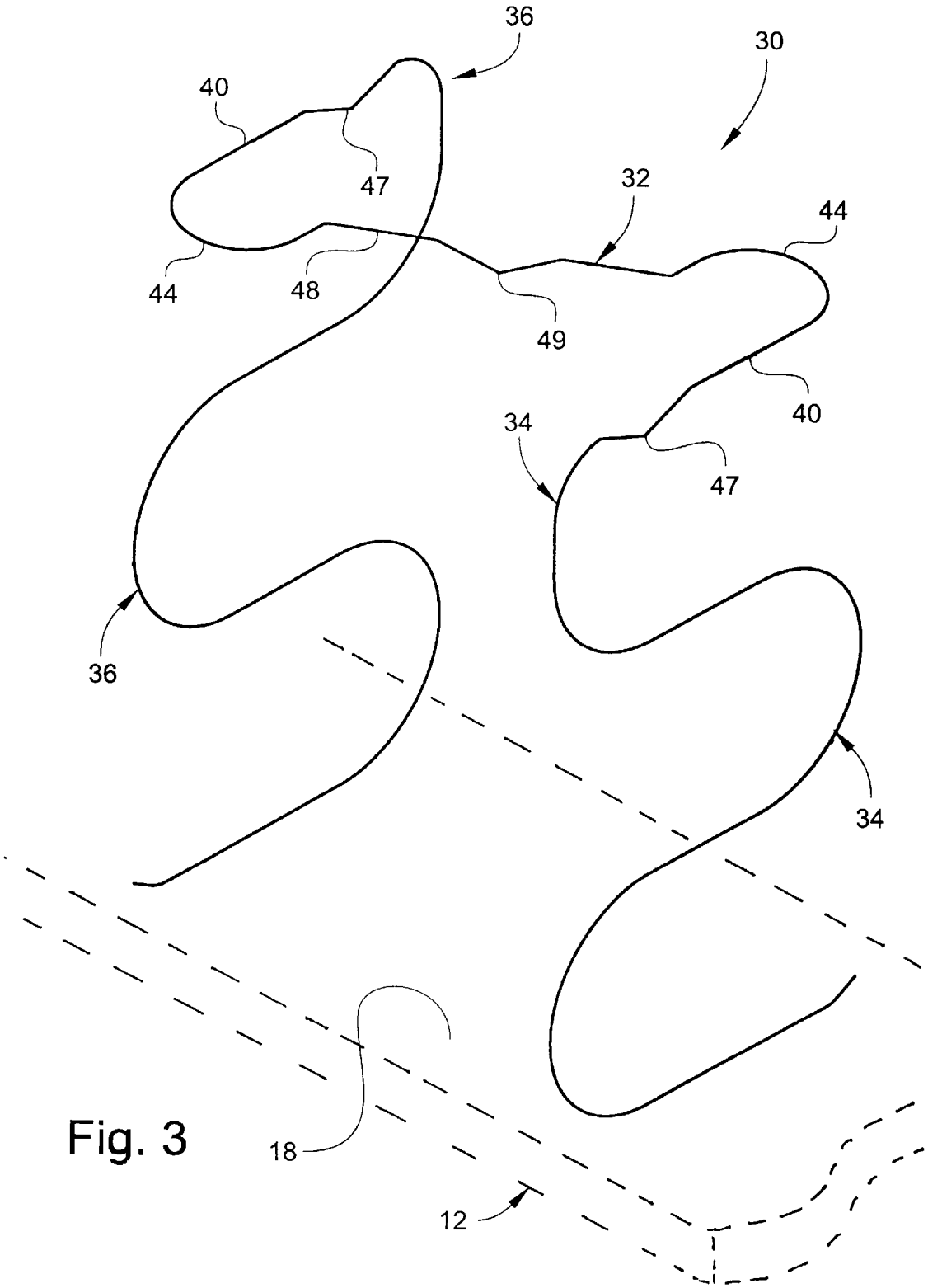
FIG. 3 is a perspective view of one of the wire spring modules of the furniture spring assembly of FIGS. 1 and 2.

As seen in FIG. 3, a preferred embodiment of the wire spring module 30 of the present invention includes a generally coplanar top 32 and two legs 34, 36. The specific shape of the legs 34, 36 may be conventional and may vary from that shown in FIG. 3. As shown, legs 34, 36 in the illustrated embodiment are formed in a resilient planar sinuous spring configuration and extend from opposite ends of the top 32 as reverse mirror images of each other, disposed in spaced parallel planes substantially perpendicular to the plane of the top 32. Each leg 34, 36 has a free terminal end distal to the top 32 which is angularly stepped or otherwise shaped in such a manner to facilitate their attachment by staple, hook, or other similar means to bottom frame 12. Also, in the preferred embodiment, wire spring module 30 is unitarily formed from a single length of spring wire that is shaped to form the top 32 and the legs 34, 36.

Figure 4:
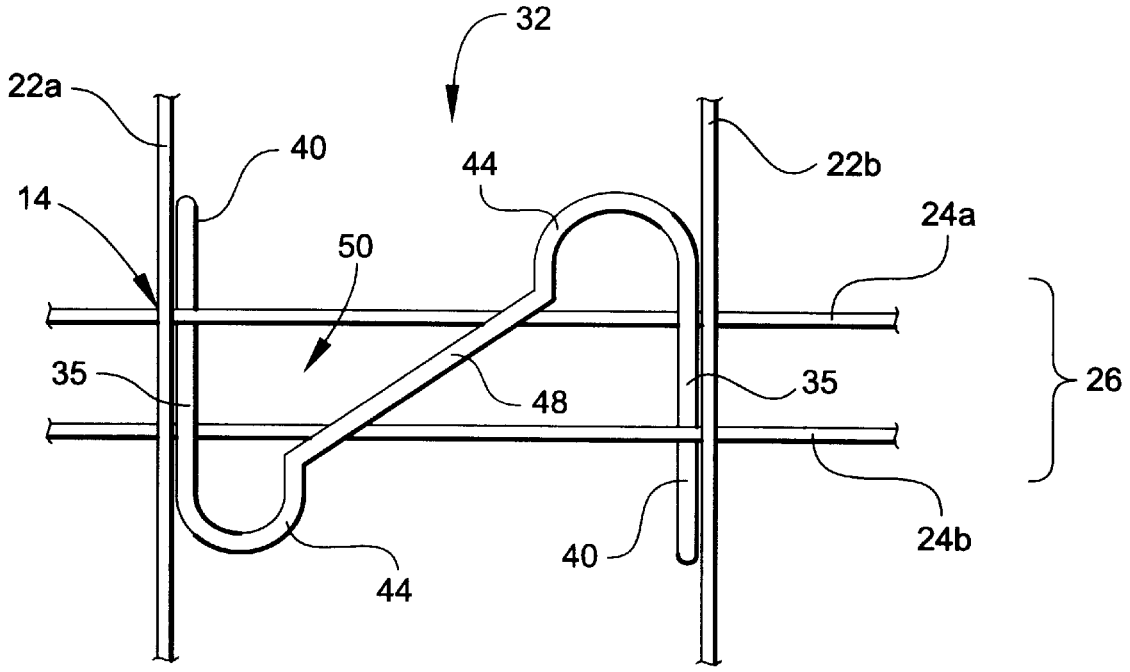
FIG. 4 is a partial top view of the furniture spring assembly of FIGS. 1 and 2, showing one representation of a wire spring module locked into a first position in the wire grid of the furniture spring assembly.
Figure 5:
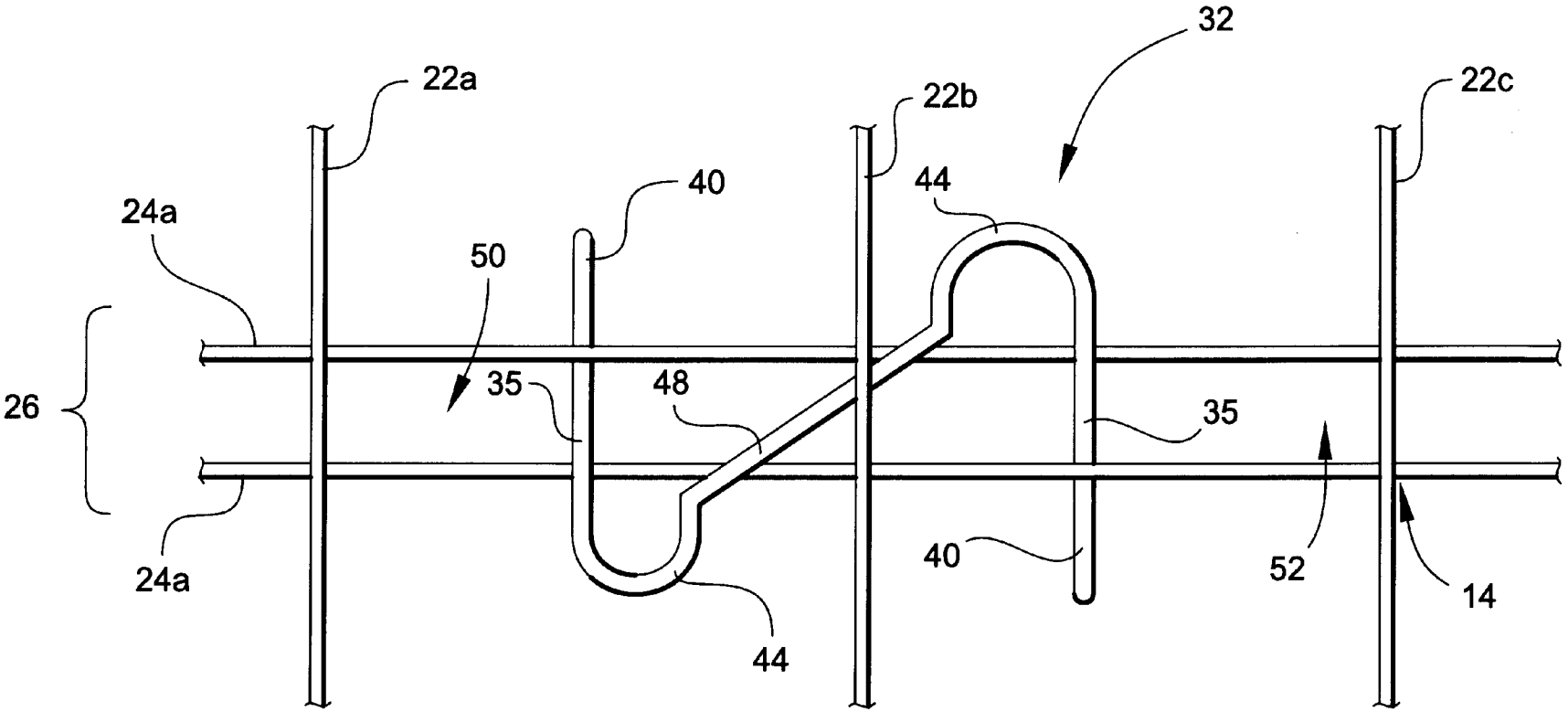
FIG. 5 is another partial top view of the furniture spring assembly of FIGS. 1 and 2, showing similarly to FIG. 4 another wire spring module locked into an alternative, second position in the wire grid of the furniture spring assembly.

As seen in each of FIGS. 3–5, the top 32 of each spring module 30 includes two generally J-shaped end segments 35 arranged in spaced parallel reverse mirror image relation to one another and connected by an intermediate segment 48, all of which are substantially coplanar with each other. Each J-shaped end segment 35 is comprised of a generally straight portion 40 and a generally U-shaped portion 44 which merge smoothly and gradually into one another without any angular relation created therebetween. Preferably, the straight portions 40 are substantially parallel to one another and the U-shaped portions 44 are disposed to extend toward one another in oppositely-facing orientations at opposite ends of the straight portions 40. The proximate ends of each U-shaped portion 44 are connected by the intermediate segment 48, which is substantially linear so as to extend diagonally between the U-shaped portions 44 and to intersect therewith forming an angular relation therebetween at each connection point. The legs 34, 36 connect to the respective ends of straight portions 40 opposite from the U-shaped portions 44.

As seen in FIG. 3, the top 32 may also include three notches 47, 49. Each generally straight portion 40 includes a notch 47, which is located generally toward the end of straight portion 40 distal from the U-shaped portion 44 and proximate to leg portions 34, 36. Intermediate segment 48 also includes a notch 49 generally at its midpoint.

FIGS. 4 and 5 illustrate, from a top plan view, two alternative manners of assembly of the wire spring modules 30 with the wire grid 14 in fabricating the spring assembly according to the preferred embodiment of the present invention, specifically two alternative positions by which the top 32 of a wire spring module 30 can be connected or "locked" into the spring placement and spring seating wires 22, 24 of the wire grid 14. In the locking position shown in FIG. 4, the top 32 of a spring module 30 is inserted and locked into a rectangular module aperture 50 of the wire grid 14 defined by one pair of spring seating wires 24*a*, 24*b*, thereby framing the two parallel lengthwise sides of the rectangular aperture 50, and by two immediately adjacent spring placement wires 22*a*, 22*b* crossing the spring seating wires 24*a*, 24*b*, thereby framing the two widthwise sides of the rectangular aperture 50. FIG. 5 illustrates a second locking position, in which the top 32 of a spring module 30 is inserted and locked between two adjacent rectangular module apertures 50, 52, defined by one pair of spring seating wires 24*a*, 24*b*, framing the two parallel lengthwise sides of both rectangular apertures 50, 52, and by three successively adjacent spring placement wires 22*a*, 22*b*, 22*c* crossing the seating wires 24*a*, 24*b*, framing the widthwise sides of the apertures 50, 52, with the intermediate placement wire 22*b* forming a common side to both apertures 50, 52.

In the position of FIG. 4, the top 32 of the spring module 30 intersects wire grid 14 in such a manner that it is held generally within the same plane as wire grid 14 by the various forces exerted by spring seating wires 24*a*, 24*b* on top portion 32. Specifically, intermediate segment 48 engages the top, i.e. the outward side, of both spring seating wires 24*a*, 24*b* of seating wire pair 26. One straight portion 40 passes through the module aperture 50 such that the end of straight portion 40 proximate to the associated U-shaped portion 44 engages the top (outer) side of spring seating wire 24*b* and one notch 47 (see FIG. 3) engages the bottom (inner) side of the spring seating wire 24*a*. Conversely, the other straight portion 40 passes through the module aperture 50 such that the end thereof proximate to the associated U-shaped portion 44 engages the top (outer) side of the spring seating wire 24*a* while the other notch 47 (see FIG. 3) engages the bottom (inner) side of the spring seating wire 24*b*. Preferably, the relative spacing of the spring seating and placement wires and the relative dimensions of the spring module 30 are such that, as so assembled, the U-shaped portions 44 do not contact the spring seating wires 24*a*, 24*b* but instead are positioned laterally outwardly of the module aperture 50 and, further, the straight portions 40 of the top 32 abut the spring placement wires 22*a*, 22*b*, respectively, thereby to maintain the spring module 30 in a relatively-fixed position between placement wires 22*a*, 22*b*.

In the position illustrated in FIG. 5, the top 32 of the wire spring module 30 intersects wire grid 14 through the module apertures 50, 52 and across the intervening placement wire 22*b* in such a manner that it is held generally within the same plane as wire grid 14 by the various forces exerted by spring seating wires 24*a*, 24*b* and the intermediate spring placement wire 22*b* on the top 32. Specifically, the intermediate segment 48 engages the top of both spring seating wires 24*a*, 24*b* of seating wire pair 26, but extends beneath the intermediate placement wire 22*b* to engage the placement wire 22*b* within the notch 49 (see FIG. 3). One straight portion 40 passes through module aperture 50 such that its end proximate to the associated U-shaped portion 44 engages the top (outer) side of spring seating wire 24*b* while one notch 47 engages the bottom (inner) side of spring seating wire 24*a*. Conversely, the other straight portion 40 passes through the adjacent module aperture 52 such that the end of such straight portion 40 proximate to its associated U-shaped portion 44 engages the top (outer) side of spring seating wire 24*a* while the other notch 47 engages the bottom (inner) side of spring seating wire 24*b*. Hereagain, it is preferred that the relative spacing of the spring seating and placement wires and the relative dimensions of the wire spring module be selected such that the U-shaped portions 44 do not contact the spring seating wires 24*a*, 24*b* and instead be positioned laterally outwardly of module apertures 50, 52. Although the straight portions 40 of the spring module 30 do not abut any of the placement wires 22*a*, 22*b*, 22*c* as in the positioning of the spring module 20 in FIG. 4, the top 32 of the spring module 30 is held in place relative to spring placement wires 22*a*, 22*b*, and 22*c* by the aforementioned engagement of the notch 49 in the intermediate segment 48 with the bottom of the intermediate spring placement wire 22*b*.

In summary, the present invention provides an improved wire grid for use with a furniture spring assembly. The wire grid aspect of the invention allows for the quick and easy attachment of an array of multiple wire spring modules of various shapes and designs. The wire grid aspect also enables each wire spring module to lock into a relatively fixed position within the wire grid, regardless of which placement position is chosen. Finally, the wire spring module aspect of this invention is ideal for locking easily and quickly into the wire grid, as disclosed, regardless of which placement position within the wire grid is chosen.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A wire spring module for use in a furniture spring assembly, the wire spring module comprising:

a generally coplanar top having a pair of generally J-shaped end segments arranged in spaced reverse mirror image relation to one another and an intermediate segment connected between respective ends of the J-shaped end segments at an angle relation therewith; and a pair of legs each formed in a resilient spring configuration, the legs being connected to respective opposite ends of the J-shaped end segments and extending therefrom in spaced relation to one another.

2. A wire spring module according to claim 1 wherein the wire spring module is unitarily formed of a single length of spring wire.

3. A wire spring module according to claim 1 wherein the intermediate segment further comprises a notch for engagement with a spring placement wire in a furniture spring assembly.

4. A wire spring module according to claim 1 wherein each generally J-shaped end segment further comprises a notch for engagement with a spring seating wire in a furniture spring assembly.

5. A wire spring module according to claim 1 wherein each generally J-shaped end segment of the generally coplanar top portion is comprised of a generally straight portion and a generally U-shaped portion, one end of the generally straight portion being connected to one end of the generally U-shaped portion, wherein the other end of each respective U-shaped portion is connected to opposite ends of the intermediate segment and wherein the other end of each straight portion is connected to a respective leg.

6. A wire spring module according to claim 5 wherein the generally straight portions of each J-shaped end segment are parallel to one another.

7. A wire spring module according to claim 5 wherein each generally straight portion of each J-shaped end segment further comprises a notch for engagement with a spring seating wire in a furniture spring assembly.

8. A wire spring module according to claim 5 wherein the intermediate segment further comprises a notch for engagement with a spring placement wire in a furniture spring assembly.

9. A wire spring module according to claim 5 wherein the generally straight portion and the generally U-shaped portion of each J-shaped end segment merge smoothly with one another without any angular relation therebetween.

10. A wire spring module according to claim 1 wherein each leg comprises a sinuous wire spring portion.

11. A wire spring module according to claim 1 wherein the legs are located in spaced planes.

12. A wire spring module according to claim 11 wherein the spaced planes are in facing, parallel relation to one another and perpendicular to the plane of the top.

13. A furniture spring assembly including:

a bottom frame;

a wire grid disposed above said bottom frame and comprising a plurality of elongate, generally coplanar straight tension wires arranged in generally perpendicular crossing relation to one another, said tension wires comprising a first sub-plurality of spring placement wires extending in generally spaced parallel relation to one another and a second sub-plurality of spring seating wires extending in generally parallel relation to one another and in generally perpendicular relation to said spring placement wires; and a plurality of wire spring modules extending between and connecting said wire grid and said bottom frame, at least one of said wire spring modules comprising, (i) a top for connecting said wire spring module to said wire grid, said top including a first end segment extending generally parallel to and in abutment with one of said spring placement wires, a second end segment generally coplanar with said first end segment and extending generally parallel to and in abutment with another one of said spring placement wires, and a connecting segment generally coplanar with and extending between said first and said second end segments, and (ii) a pair of legs each formed in a resilient spring configuration, each said leg extending from an end of a respective said end segment to said bottom frame.

14. A furniture spring assembly according to claim 13, wherein said first end segment extends over a first one of said spring seating wires and under a second one of said spring seating wires and said second end segment extends under said first spring seating wire and over said second spring seating wire.

15. A furniture spring assembly according to claim 14, wherein said connecting segment extends over at least one of said first and said second spring seating wires.

16. A furniture spring assembly according to claim 14, wherein said connecting segment extends over both said first and said second spring seating wires.

17. A furniture spring assembly according to claim 13, wherein each of said first and said second end segments is J-shaped and includes a notch for receiving one said spring seating wire.

18. A furniture spring assembly according to claim 17, wherein said connecting segment is generally straight and intersects an end of each said J-shaped end segment at an angle.

19. A furniture spring assembly according to claim 13, wherein said spring seating wires are arranged in a plurality of seating wire pairs with said spring seating wires of each said spring seating wire pair disposed at a first predetermined spacing from one another and with each said spring seating wire pair disposed at a second predetermined spacing from each said seating wire pair that is adjacent thereto, said second predetermined spacing being greater than said first predetermined spacing.

20. A furniture spring assembly including:

a bottom frame;

a wire grid disposed above said bottom frame and comprising a plurality of elongate, generally coplanar straight tension wires arranged in generally perpendicular crossing relation to one another, said tension wires comprising a first sub-plurality of spring placement wires extending in generally spaced parallel relation to one another and a second sub-plurality of spring seating wires extending in generally parallel relation to one another and in generally perpendicular relation to said spring placement wires; and a plurality of wire spring modules extending between and connecting said wire grid and said bottom frame, at least one of said wire spring modules comprising, (i) a top for connecting said wire spring module to said wire grid, said top including, (a) a first end segment extending under a first of said spring seating wires and over a second of said spring seating wires, (b) a second end segment generally coplanar with said first end segment and extending over said first spring seating wire and under said second spring seating wire, and (c) a connecting segment generally coplanar with and extending between said first and said second end segments and extending over both said first and said second spring seating wires, and (ii) a pair of legs each formed in a resilient spring configuration, each said leg extending from a respective said end segment to said bottom frame.

21. A furniture spring assembly according to claim 20, wherein one of said spring placement wires extends over said connecting segment.

22. A furniture spring assembly according to claim 21, wherein said spring placement wire extends over a middle portion of said connecting segment.

23. A furniture spring assembly according to claim 20, wherein each of said first and said second end segments is J-shaped and includes a notch for receiving one said spring seating wire.

24. A furniture spring assembly according to claim 23, wherein said connecting segment is generally straight and intersects an end of each said J-shaped end segment at an angle.

25. A furniture spring assembly according to claim 24, wherein one of said spring placement wires extends over a middle portion of said connecting segment.

26. A furniture spring assembly including:

a bottom frame;

a wire grid for mounting an array of multiple spring modules to the wire grid, the wire grid horizontally disposed a predetermined distance above the bottom frame and comprising a plurality of elongate wires arranged in generally perpendicular crossing relation to one another, the wires comprising a first sub-plurality of spring placement wires extending in generally spaced parallel relation to one another and a second sub-plurality of spring seating wires extending in generally parallel relation to one another and in generally perpendicular relation to the spring placement wires, the spring seating wires being arranged in a plurality of seating wire pairs with the spring seating wires of each seating wire pair disposed at a first predetermined spacing from one another and with each seating wire pair disposed at a second predetermined spacing from each seating wire pair adjacent thereto; and a plurality of wire spring modules extending between the wire grid and the bottom frame, each wire spring module comprising a top and a pair of legs, the top including first and second generally coplanar attachment segments for connecting the wire spring module to the wire grid, each of the legs being formed in a resilient spring configuration and extending in spaced relation from opposite ends of the top for connecting each end of the top with the bottom frame;

wherein elongate wires of the wire grid are generally coplanar, straight tension wires and wherein the first and second generally coplanar attachment segments further comprise a notch and wherein each wire spring module connects to the wire grid in a generally rectangular module aperture defined by the spring seating wires of one seating wire pair and by two spring placement wires crossing the one seating wire pair, the top of the wire spring module being mounted within the module aperture so that the first attachment segment engages an inner side of the other spring seating wire, the first attachment segment abuts one of the two spring placement wires, the second attachment segment engages an outer side of the other spring seating wire, the notch of the second attachment segment engages an inner side of the one spring seating wire, and the second attachment segment abuts the other of the two spring placement wires.

27. A furniture spring assembly including:

a bottom frame;

a wire grid for mounting an array of multiple spring modules to the wire grid, the wire grid horizontally disposed a predetermined distance above the bottom frame and comprising a plurality of elongate wires arranged in generally perpendicular crossing relation to one another, the wires comprising a first sub-plurality of spring placement wires extending in generally spaced parallel relation to one another and a second sub-plurality of spring seating wires extending in generally parallel relation to one another and in generally perpendicular relation to the spring placement wires, the spring seating wires being arranged in a plurality of seating wire pairs with the spring seating wires of each seating wire pair disposed at a first predetermined spacing from one another and with each seating wire pair disposed at a second predetermined spacing from each seating wire pair adjacent thereto; and a plurality of wire spring modules extending between the wire grid and the bottom frame, each wire spring module comprising a top and a pair of legs, the top including first and second generally coplanar attachment segments for connecting the wire spring module to the wire grid, each of the legs being formed in a resilient spring configuration and extending in spaced relation from opposite ends of the top for connecting each end of the top with the bottom frame;

wherein elongate wires of the wire grid are generally coplanar, straight tension wires and wherein the top of each wire spring module further comprises three notches, a first notch in the first generally coplanar attachment segment, a second notch in the second generally coplanar attachment segment, and a third notch generally at the intersection of the first and second generally coplanar attachment segments, and wherein each wire spring module connects to the wire grid in two adjacent generally rectangular module apertures defined by the spring seating wires of a seating wire pair and by three successively adjacent spring placement wires, the top of the wire spring module being mounted within the two rectangular module apertures so that the first attachment segment engages an outer side of one spring seating wire and the first notch engages an inner side of the other spring seating wire and the second attachment segment engages an outer side of the other spring seating wire and the second notch engages an inner side of the one spring seating wire, with the third notch of the top engaging an inner side of the intermediate one of the three spring placement wires.

* * * * *